US009525254B2

(12) United States Patent
Chen

(10) Patent No.: US 9,525,254 B2
(45) Date of Patent: Dec. 20, 2016

(54) ELECTRICAL POWER CONNECTOR AND A TERMINAL ASSEMBLY

(71) Applicant: Oupiin Electronic (Kunshan) Co., Ltd, Kunshan (CN)

(72) Inventor: Hsin Chih Chen, Kunshan (CN)

(73) Assignee: OUPIIN ELECTRONIC (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 14/952,932

(22) Filed: Nov. 26, 2015

(65) Prior Publication Data

US 2016/0233635 A1 Aug. 11, 2016

(30) Foreign Application Priority Data

Feb. 9, 2015 (CN) ..... 2015 2 0087997 U

(51) Int. Cl.
*H01R 13/18* (2006.01)
*H01R 27/02* (2006.01)

(52) U.S. Cl.
CPC ..... *H01R 27/02* (2013.01)

(58) Field of Classification Search
CPC ..... H01R 13/18; H01R 13/113; H01R 23/725; H01R 23/02
USPC ..... 439/839, 682
See application file for complete search history.

(56) References Cited

U.S. PATENT DOCUMENTS 3,955,869 A * 5/1976 Licht ..... H01R 13/114 439/218
7,892,050 B2 * 2/2011 Pavlovic ..... H01R 9/245 439/250
8,449,338 B2 * 5/2013 Gong ..... H01R 13/113 439/682
8,998,655 B2 * 4/2015 Glick ..... H01R 13/187 439/839
9,312,645 B2 * 4/2016 Orris ..... H01R 24/20
2010/0323563 A1 * 12/2010 Pavlovic ..... H01R 9/245 439/839
2011/0076901 A1 * 3/2011 Glick ..... H01R 9/245 439/839
2016/0064848 A1 * 3/2016 Yu ..... H01R 13/41 439/682

* cited by examiner

*Primary Examiner* — Gary Paumen
(74) *Attorney, Agent, or Firm* — JMB Davis Ben-David

(57) ABSTRACT

An electrical power connector and a terminal assembly are disclosed. The electrical power connector includes a base and two terminal assemblies arranged up and down and being in a left-right staggered arrangement. Each terminal assembly includes a conductive terminal and two reinforcing terminals located on two sides of the conductive terminal. L-shaped pressing portions of the two reinforcing terminals together clamp arc protruding parts of the conductive terminal, so that the two terminal assemblies have high conductivity and good elastic to provide a better electrical performance and a long term reliable connection.

10 Claims, 7 Drawing Sheets

ELECTRICAL POWER CONNECTOR AND A TERMINAL ASSEMBLY

CROSS REFERENCE TO RELATED APPLICATIONS

Benefit is claimed to China Patent Application No. 201520087997.9, filed Feb. 9, 2015, the contents of which are incorporated by reference in their entirety herein.

BACKGROUND OF THE INVENTION

1. Field of the Invention

The present invention relates to a connector technology, and more particularly to an electrical power connector and a terminal assembly used in the electrical power connector.

2. Description of the Prior Art

The characteristics of a new electrical power connector on the current market are high rated current and low energy loss. The design of an elastic arm is used in a terminal of the electrical power connector for providing an adequate and reliable contact to fit the deviation of the size or the position. Usually, in order to improve the electrical conductivity of the elastic arm, the elasticity of the elastic arm is reduced. But this is not good for the reliable connection and frequent insertion between the electrical power connector a butt connector. On the contrary, if the elasticity of the elastic arm is greater, the contact force and the electrical conductivity between the electrical power connector and the butt connector become worse, so that the prior electrical power connector can not meet the application of high current.

Moreover, the prior electrical power connector generally includes only one terminal having an integral structure. This terminal can only act as a positive electrode or a negative electrode of a power supply, so the prior electrical power connector can only be used to transfer an unidirectional current. The application of the prior electrical power connector is limited.

Hence, it is needed to provide a new electrical power connector, which has a wide range of application, a good electrical performance and a reliable connection, and also provide a terminal assembly with high electrical conductivity and high elasticity.

BRIEF SUMMARY OF THE INVENTION

A primary object of the present invention is to provide an electrical power connector, which employs a terminal assembly with high electrical conductivity and high elasticity, for providing a better electrical performance and a long term reliable connection.

Another object of the present invention is to provide a terminal assembly with high electrical conductivity and high elasticity for providing a better electrical performance and a long term reliable connection.

The other object and the advantage of the present invention may be further understood from the technical features disclosed by the present invention.

To achieve the above object of the present invention, the present invention adopts the following technical solution.

The present invention provides an electrical power connector, which comprises a base, a first terminal assembly and a second terminal assembly. The base includes an engaging portion located at the front thereof, a mounting portion located at the rear thereof, a first insertion opening formed on the engaging portion, a second insertion opening formed on the engaging portion and located under the first insertion opening, a first terminal-receiving passage located on left and right sides of the first insertion opening, communicated with the first insertion opening and extending to a rear surface of the mounting portion, and a second terminal-receiving passage located on left and right sides of the second insertion opening, communicated with the second insertion opening and extending to the rear surface of the mounting portion. The first terminal assembly is mounted in the first terminal-receiving passage and includes a first conductive terminal and two first reinforcing terminals located on two sides of the first conductive terminal. The first conductive terminal has two first vertical plates, two pairs of first flexible arms formed by being separately bent from front edges of the two first vertical plates and extending forward, a first horizontal plate connecting the two first vertical plates, and a first mounting end located under one of the two first vertical plates. Each first reinforcing terminal has a first upright portion attached to an outer side of the corresponding first vertical plate, and a first pressing portion that is formed by being bent from a front edge of the first upright portion and extending forward and presses an outer side of the corresponding first flexible arm. Wherein the two first vertical plates are mounted in the mounting portion, the first flexible arms pass through the first terminal-receiving passage to protrude into the first insertion opening, the first horizontal plate is fixed in the mounting portion, and the first mounting end extends out of a bottom surface of the base. The second terminal assembly is mounted in the second terminal-receiving passage and includes a second conductive terminal and two second reinforcing terminals located on two sides of the second conductive terminal. The second conductive terminal has two second vertical plates, two pairs of second flexible arms formed by being separately bent from front edges of the two second vertical plates and extending forward, a second horizontal plate connecting the two second vertical plates, and a second mounting end located under one of the two second vertical plates. Each second reinforcing terminal has a second upright portion attached to an outer side of the corresponding second vertical plate, and a second pressing portion that is formed by being bent from a front edge of the second upright portion and extending forward and presses an outer side of the corresponding second flexible arm. Wherein the two second vertical plates are mounted in the mounting portion, the second flexible arms pass through the second terminal-receiving passage to protrude into the second insertion opening, the second horizontal plate is fixed in the mounting portion, and the second mounting end extends out of the bottom surface of the base.

In one embodiment, the first and second insertion openings are arranged up and down in a left-right staggered arrangement, and communicated with each other.

In one embodiment, the mounting portion of the base includes an upright first partition and an upright second partition, which are disposed in a left-right staggered arrangement; the first partition is located in the first terminal-receiving passage and divides the first terminal-receiving passage into two parts; the first partition extends forward from the rear surface of the mounting portion and is stopped on the first insertion opening; the second partition is located in the second terminal-receiving passage and divides the second terminal-receiving passage into two parts; and the second partition extends forward from the rear surface of the mounting portion and is stopped on the second insertion opening.

In one embodiment, the base disposes a first space formed between the first partition and an inner top wall of the first terminal-receiving passage, and a first shoulder formed on the top of the first partition; the base further disposes two first holding grooves, which are separately formed on left and right inner sidewalls of the first terminal-receiving passage and located on two sides of the first partition; the base forms at least one first window located on each of the left and right sides of the first insertion opening and used to communicate the first insertion opening with the first terminal-receiving passage; the base further forms a first locking groove on the mounting portion; and the first locking groove is formed on an inner bottom wall of the first terminal-receiving passage and vertically extends downward to pass through the bottom surface of the mounting portion.

In one embodiment, each first flexible arm forms a first arc protruding part and a first head part; the first arc protruding parts of the two pairs of the first flexible arms are close to each other and are spaced apart, and the first head parts thereof extend away from each other to form a splayed shape; an outward extension length of one first head part is larger than that of the other first head part; the first conductive terminal includes two first holding plates, which are separately formed on the upper edges of the two first vertical plates; each of the two first holding plates are bent toward outside of the first conductive terminal to form an L shape; the first conductive terminal further includes two first bending plates, which are separately formed on rear edges of the two first vertical plates. Wherein the first arc protruding parts protrude from the corresponding first windows into the first insertion opening; the first horizontal plate is inserted into the first space above the first partition; the first holding plates are held in the corresponding first holding grooves; and the first mounting end passes through the first locking groove and extends out of the bottom surface of the base.

In one embodiment, the first pressing portion is L-shaped; two first end portions separately formed on the first pressing portions of the two first reinforcing terminals together clamp the first arc protruding parts of the first conductive terminal; each first reinforcing terminal further has a first notch formed on a rear edge of the first upright portion; the first bending plate of the first conductive terminal enters into the first notch of the corresponding first reinforcing terminal; and the first holding plate of the first conductive terminal crosses a top edge of the first upright portion of the corresponding first reinforcing terminal to be engaged with the first holding groove of the base.

In one embodiment, the base disposes a second space formed between the second partition and an inner top wall of the second terminal-receiving passage, and a second shoulder formed on the top of the second partition; the base further disposes two second holding grooves, which are separately formed on left and right inner sidewalls of the second terminal-receiving passage and located on two sides of the second partition; the base forms at least one second window located on each of the left and right sides of the second insertion opening and used to communicate the second insertion opening with the second terminal-receiving passage; the base further forms two second locking grooves on the mounting portion; and the two second locking grooves are separately located on the two sides of the second partition, are formed on an inner bottom wall of the second terminal-receiving passage and passes through the bottom surface of the mounting portion.

In one embodiment, each second flexible arm forms a second arc protruding part and a second head part; the second arc protruding parts of the two pairs of the second flexible arms are close to each other and are spaced apart, and the second head parts thereof extend away from each other to form a splayed shape; an outward extension length of one second head part is larger than that of the other second head part; the second conductive terminal includes an upright second holding plate and an L-shaped second holding plate, which are separately formed on the upper edges of the two second vertical plates; the second conductive terminal further includes two second bending plates, which are separately formed on rear edges of the second vertical plates. Wherein the second arc protruding parts protrude from the corresponding second windows into the second insertion opening; the second horizontal plate is inserted into the second space above the second partition; the upright second holding plate and the L-shaped second holding plate are separately held in the corresponding second holding grooves; one second vertical plate with the second mounting end is retained by one second locking groove, and the second mounting end passes through the one second locking groove to extend out of the bottom surface of the base; and the other second vertical plate without the second mounting end is retained in the other second locking groove together with the second upright portion of the second reinforcing terminal.

In one embodiment, the second pressing portion is L-shaped; two second end portions separately formed on the second pressing portions of the two second reinforcing terminals together clamp the second arc protruding parts of the second conductive terminal; each second reinforcing terminal further has a second notch formed on a rear edge of the second upright portion; the second bending plate of the second conductive terminal enters into the second notch of the corresponding second reinforcing terminal; the L-shaped second holding plate of the second conductive terminal crosses a top edge of the second upright portion of the corresponding second reinforcing terminal to be engaged with the second holding groove of the base.

The present invention also provides a terminal assembly, which is applied to an electrical power connector. The terminal assembly comprises a conductive terminal and two reinforcing terminals, which is located on two sides of the conductive terminal. The conductive terminal has two vertical plates, two pairs of flexible arms formed by being separately bent from front edges of the two vertical plates and extending forward, a horizontal plate connecting the two vertical plates, and a mounting end located under one of the two vertical plates. Wherein each flexible arm forms an arc protruding part and a head part. The arc protruding parts of the two pairs of the flexible arms is close to each other and spaced apart, and the head parts thereof extend away from each other to form a splayed shape; an outward extension length of one head part is larger than that of the other head part. Each reinforcing terminal has an upright portion attached to an outer side of the corresponding vertical plate, and an L-shaped pressing portion that is formed by being bent from a front edge of the upright portion and extending forward and presses an outer side of the corresponding flexible arm. Wherein two end portions of the L-shaped pressing portions of the two reinforcing terminals together clamp the arc protruding parts of the conductive terminal.

In comparison with the prior art, the electrical power connector of the present invention employs two terminal assemblies having high conductivity and good elastic to provide a better electrical performance and a long term reliable connection. Moreover, because the electrical power connector employs two separate terminal assemblies, which can use two kinds of different polarity currents, to expand the use range of the electrical power connector.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention.

Figure 1:
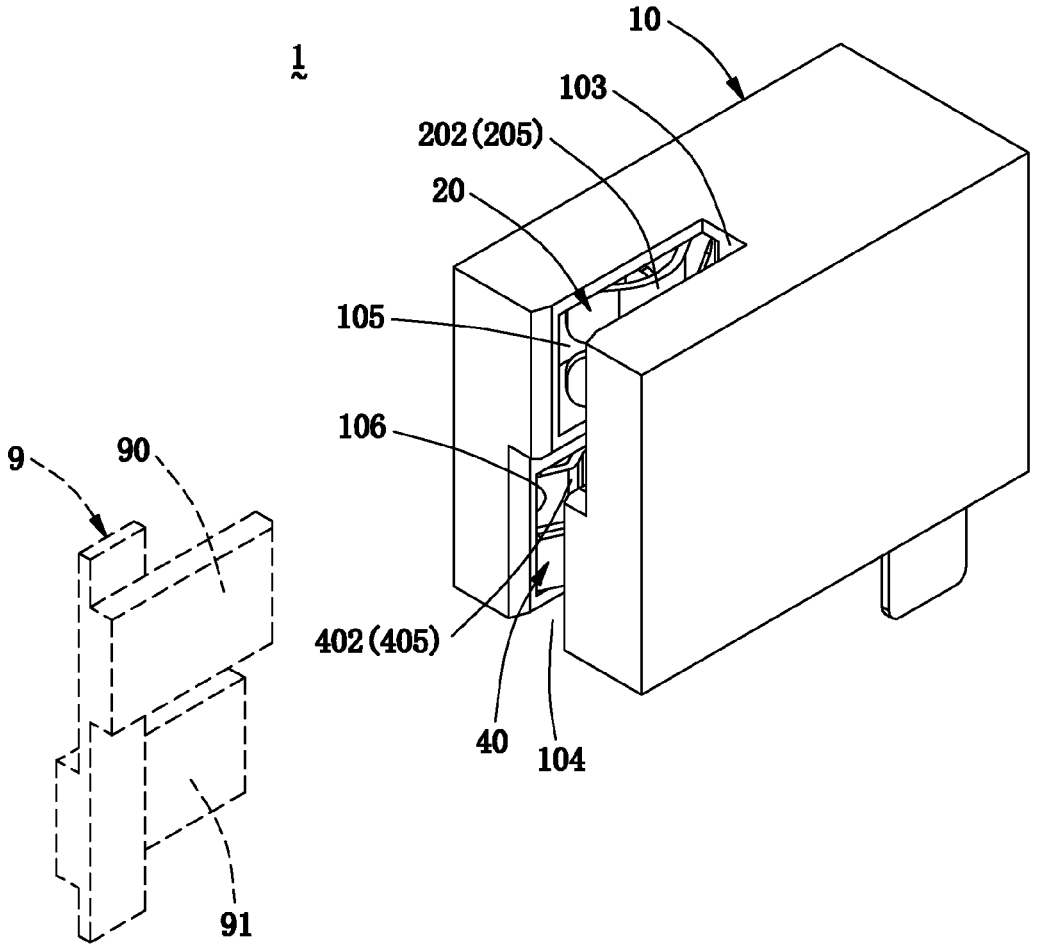
FIG. 1 is a perspective schematic view of an electrical power connector of the present invention, wherein the dotted part indicates a butt connector mated with the electrical connector.
Figure 2:
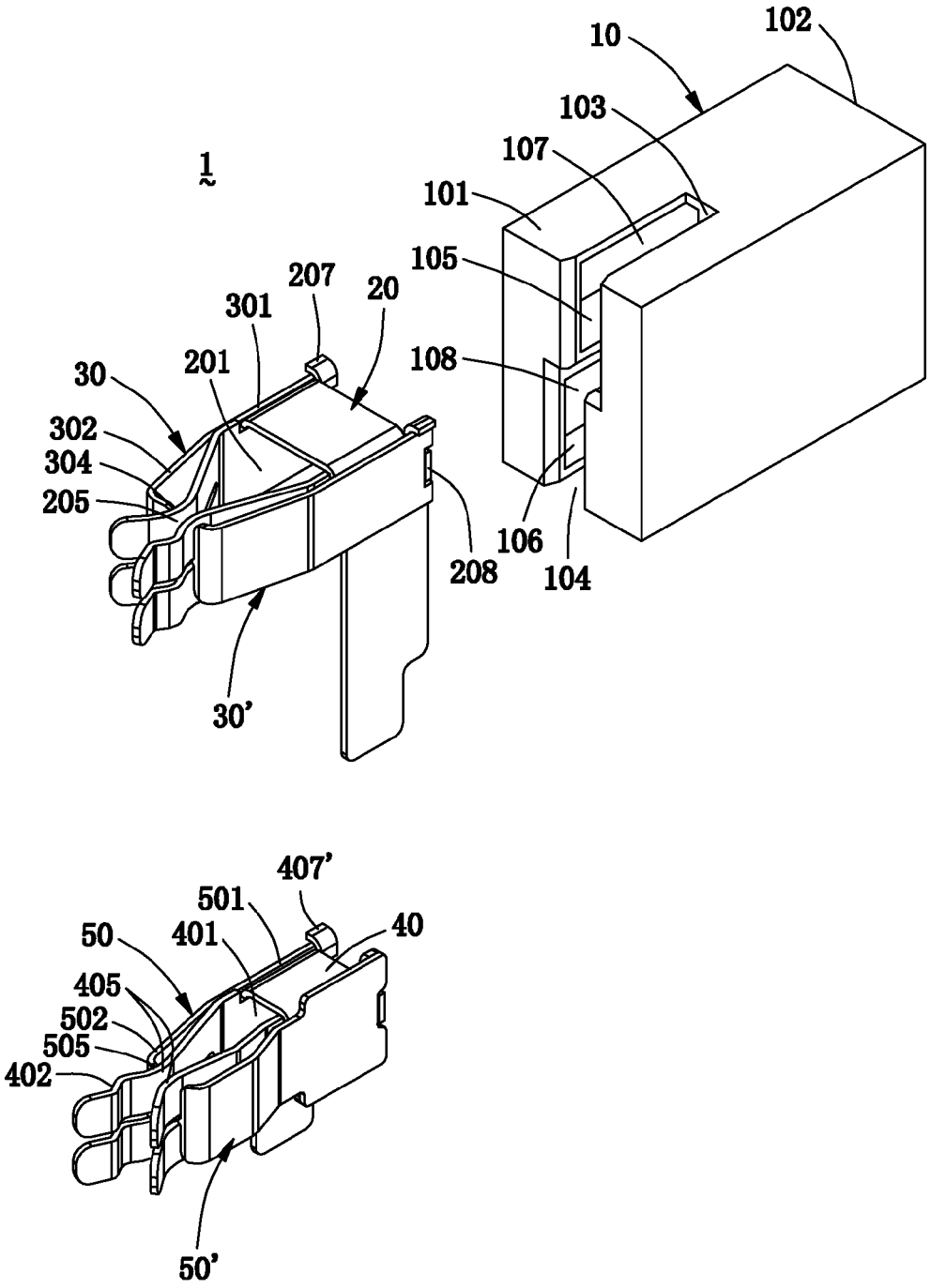
FIG. 2 is an exploded view of the electrical power connector shown by FIG. 1.
Figure 3:
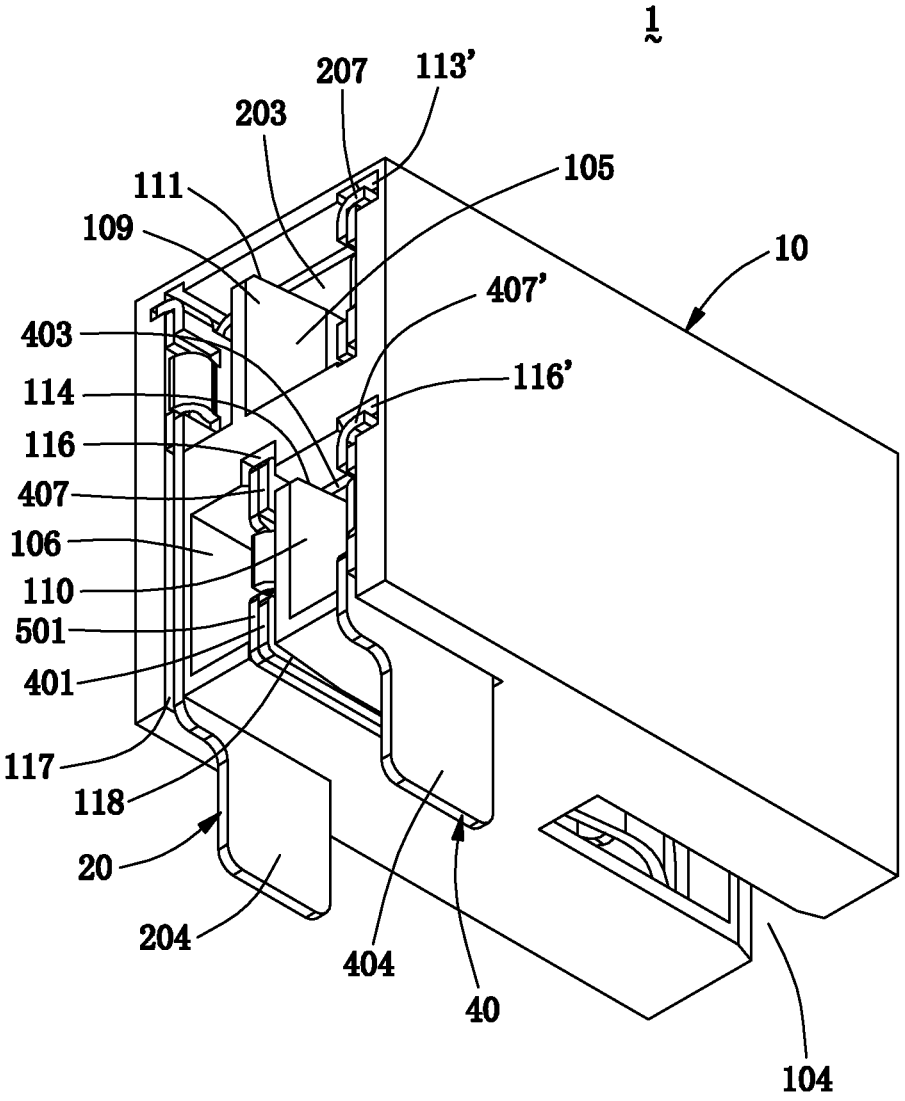
FIG. 3 is a perspective schematic view of the electrical power connector of the present invention in another direction.
Figure 4:
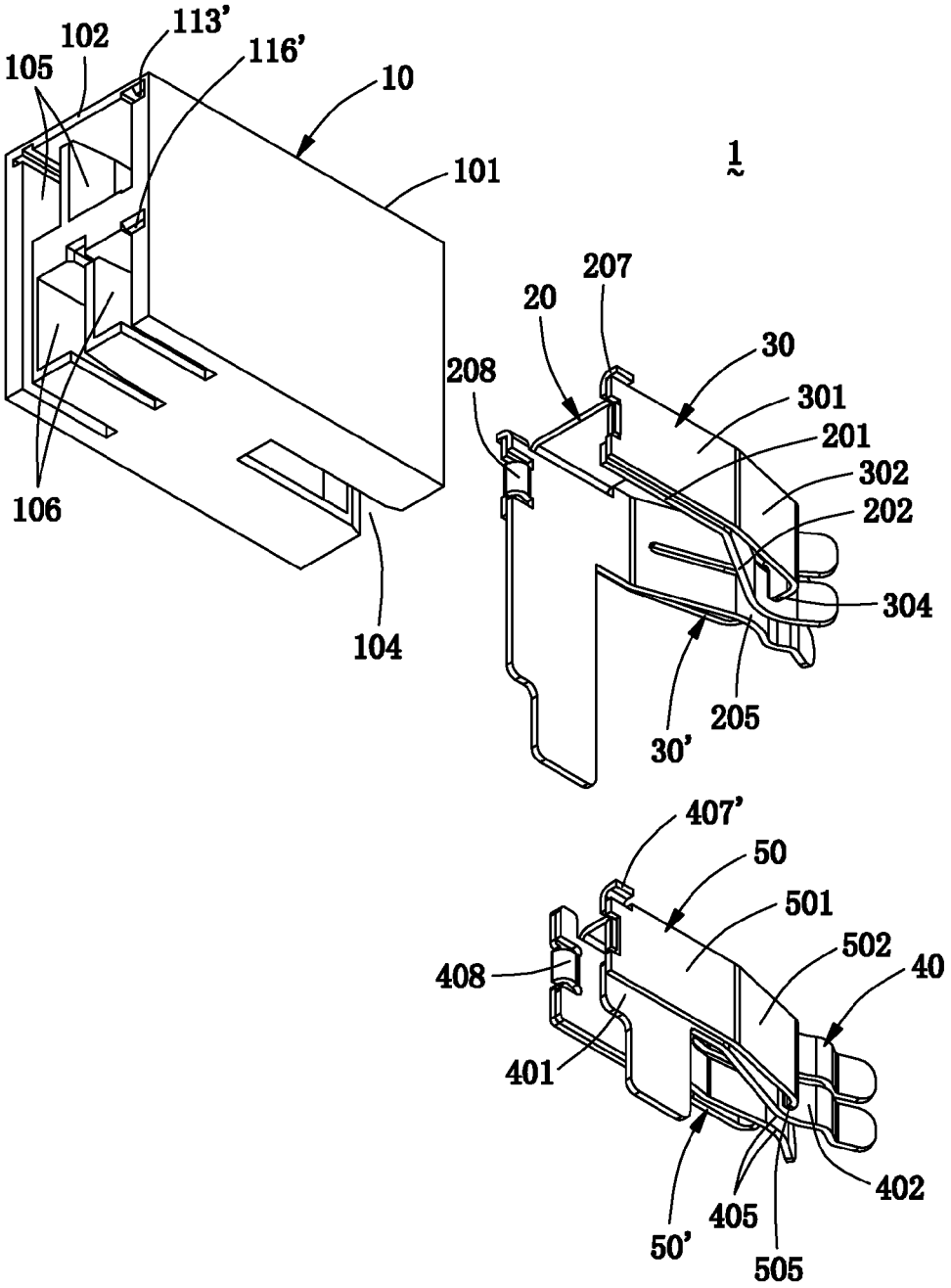
FIG. 4 is an exploded view of the electrical power connector shown by FIG. 3.

Please refer to FIGS. 1 to 4, FIG. 1 is a perspective schematic view of an electrical power connector 1 of the present invention, wherein the dotted part indicates a butt connector 9 mated with the electrical connector 1; FIG. 2 is an exploded view of the electrical power connector 1 shown by FIG. 1; FIG. 3 is a perspective schematic view of the electrical power connector 1 of the present invention in another direction; and FIG. 4 is an exploded view of the electrical power connector 1 shown by FIG. 3.

Please refer to FIGS. 1 to 4, the electrical power connector 1 comprises a base 10, a first terminal assembly mounted on the base 10, and a second terminal assembly mounted on the base and located under the first terminal assembly.

Please refer to FIGS. 2 and 4, the base 10 is generally rectangular. The base 10 includes an engaging portion 101 located at the front thereof, a mounting portion 102 located at the rear thereof, a first upright insertion opening 103 formed on the engaging portion 101, a second upright insertion opening 104 formed on the engaging portion 101 and located under the first insertion opening 103, a first terminal-receiving passage 105 located on left and right sides of the first insertion opening 103 to be communicated with the first insertion opening 103 and extend to a rear surface of the mounting portion 102, and a second terminal-receiving passage 106 located on left and right sides of the second insertion opening 104, communicated with the second insertion opening 104 and extending to the rear surface of the mounting portion 102.

As shown in FIG. 2, in this embodiment, the first insertion opening 103 and the second insertion opening 104 are arranged up and down in a left-right staggered arrangement, and communicated with each other. Namely, the first and second insertion openings 103, 104 are not arranged in one vertical line. The first and second insertion openings 103, 104 extend rearward from a front surface of the engaging portion 101, and the extension length thereof is equal to approximately half of a length of the base 10. The base 10 also includes at least one first window 107 located on each of the left and right sides of the first insertion opening 103 and at least one second window 108 located on each of the left and right sides of the second insertion opening 104. Therefore, the first insertion openings 103 can be communicated with the first terminal-receiving passage 105 located the two sides thereof by the first window 107, and the second insertion openings 104 can be communicated with the second terminal-receiving passage 106 located the two sides thereof by the second window 108. In other embodiments, the first and second insertion openings 103, 104 may be arranged in one vertical line according to need.

As shown in FIGS. 2 and 4, in this embodiment, the first and second terminal-receiving passages 105, 106 pass through the front surface of the engaging portion 101 and the rear surface of the mounting surface 102.

Figure 5:
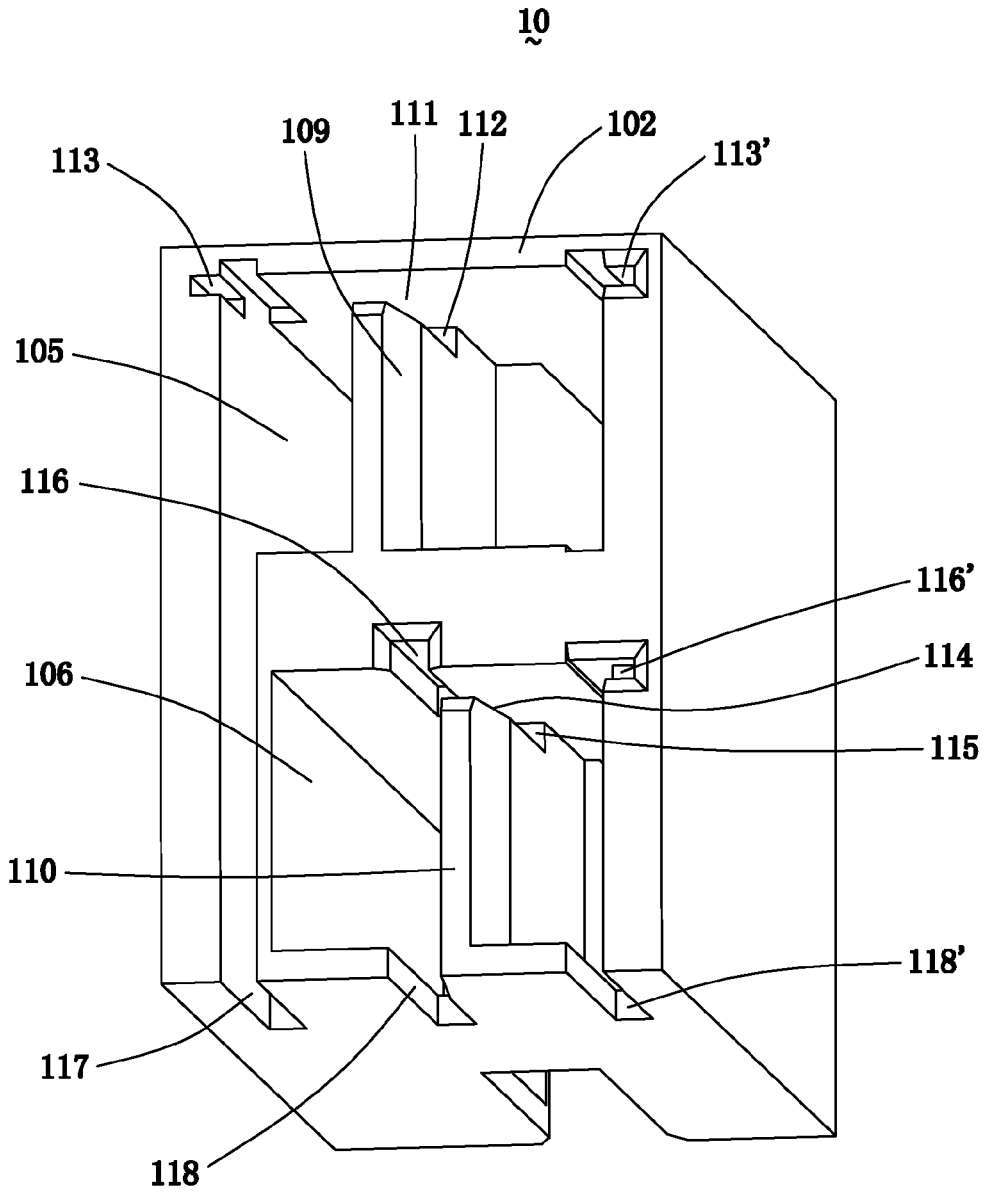
FIG. 5 is a perspective schematic view of a base of the electrical power connector of the present invention.

Please refer to FIG. 5, the mounting portion 102 of the base 10 disposes an upright first partition 109 and an upright second partition 110 located under the first partition 109. The first partition 109 is located in the first terminal-receiving passage 105 and divides the first terminal-receiving passage 105 into two parts. Further, the first partition 109 extends forward from the rear surface of the mounting portion 102 to the first insertion opening 103. There forms a first space 111 between the first partition 109 and an inner top wall of the first terminal-receiving passage 105. The first partition 109 forms a first shoulder 112 located on the top thereof. Moreover, the base 10 also includes two first holding grooves 113, 113', which are separately formed on left and right inner sidewalls of the first terminal-receiving passage 105 and located on two sides of the first partition 109. The second partition 110 is located in the second terminal-receiving passage 106 and divides the second terminal-receiving passage 106 into two parts. The second partition 110 extends forward from the rear surface of the mounting portion 102 to the second insertion opening 104. There forms a second space 114 between the second partition 110 and an inner top wall of the second terminal-receiving passage 106. The second partition 110 forms a second shoulder 115 located on the top thereof. The base 10 further includes two second holding grooves 116, 116', one of which is formed on one inner sidewall of the second terminal-receiving passage 106, and the other of which is formed on the inner top wall thereof. The two second holding grooves 116, 116' are separately formed on two sides of the second partition 110. In this embodiment, the first and second partitions 109, 110 are disposed in a left-right staggered arrangement.

Please refer to FIG. 5, the mounting portion 102 of the base 10 further disposes a first locking groove 117 and two second locking grooves 118, 118'. The first locking groove 117 is formed on an inner bottom wall of the first terminal-receiving passage 105 and vertically extends downward to pass through a bottom surface of the mounting portion 102. The two second locking grooves 118, 118' are separately located on the two sides of the second partition 110, formed on an inner bottom wall of the second terminal-receiving passage 106 and passes through the bottom surface of the mounting portion 102.

Figure 6:
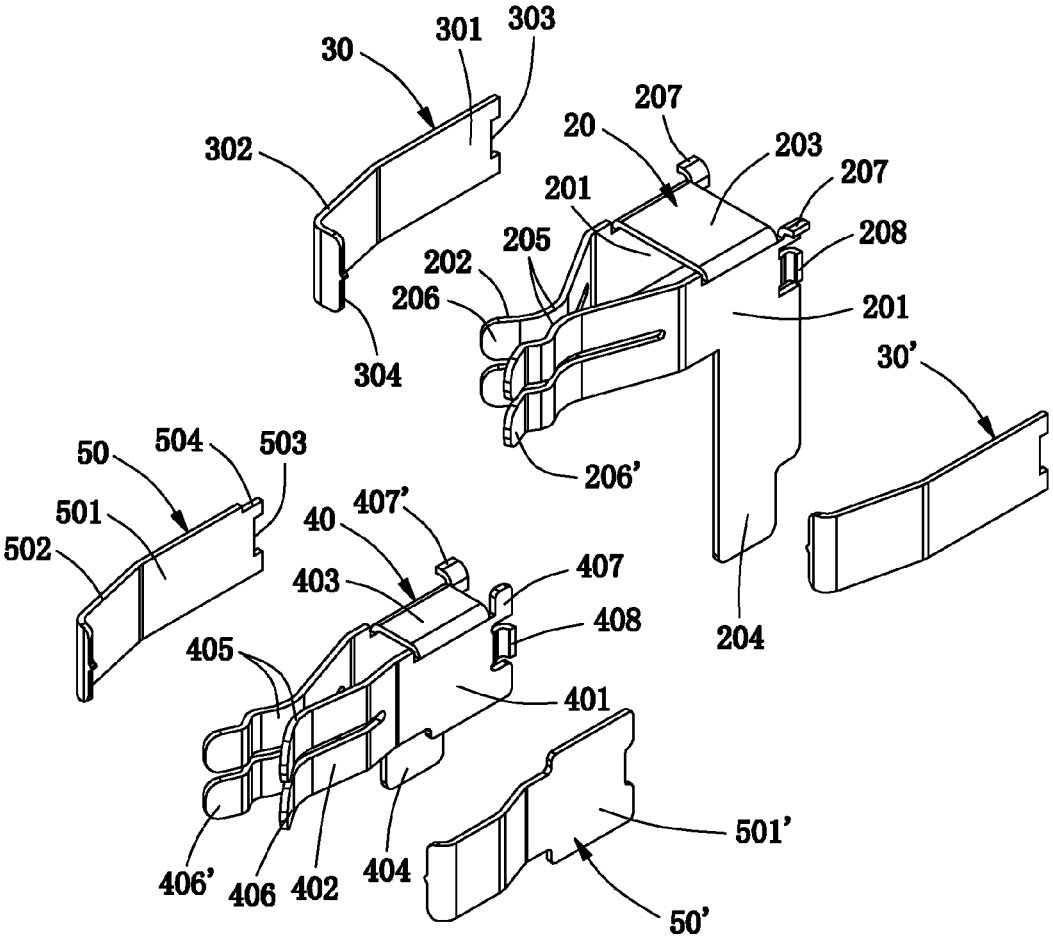
FIG. 6 is a perspective schematic view of a first terminal assembly shown in FIG. 2 after disassembling.
Figure 7:
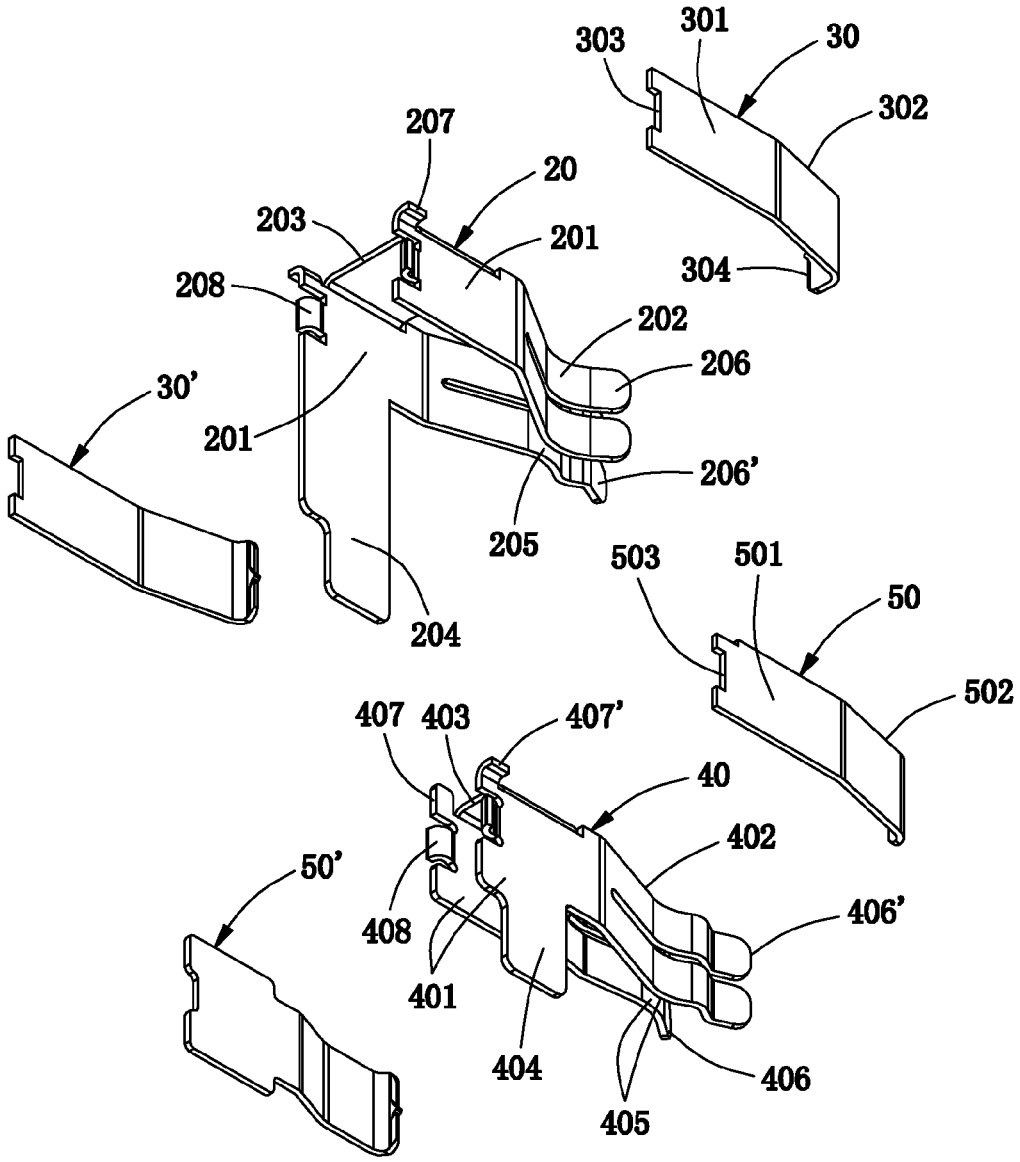
FIG. 7 is a perspective schematic view of a second terminal assembly shown in FIG. 4 after disassembling.

Please refer to FIGS. 6 and 7, the first terminal assembly includes a first conductive terminal 20 and two first reinforcing terminals 30, 30' located on two sides of the first conductive terminal 20.

As shown in FIGS. 6 and 7, the first conductive terminal 20 includes two parallel arranged first vertical plates 201, two pairs of first flexible arms 202 formed by being separately bent from front edges of the two first vertical plates 201 and extending forward, a first horizontal plate 203 connecting upper edges of the two first vertical plates 201, and a first mounting end 204 located under one of the two first vertical plates 201. Each first flexible arm 202 forms a first arc protruding part 205 and a first head part 206 (206'). The first arc protruding parts 205 of the two pairs of the first flexible arms 202 are close to each other, but are spaced a distance. The two first head parts 206, 206' thereof extend away from each other to form a splayed shape. The outward extension length of the first head part 206' is larger than that of the first head part 206. Further, the first conductive terminal 20 includes two first holding plates 207, which are separately formed on the upper edges of the two first vertical plates 201. Each of the two first holding plates 207 are bent toward outside of the first conductive terminal 20 to form an L shape. The first conductive terminal 20 also includes two first bending plates 208, which are separately formed on rear edges of the two first vertical plates 201. In this embodiment, the first mounting end 204 of the first conductive terminal 20 is vertical and integral with one of the two first vertical plates 201. Of course, the first mounting end 204 may be disposed to be L-shaped according to need in others embodiments.

As shown in FIGS. 6 and 7, because the two first reinforcing terminals 30, 30' have the same structures, here will take one first reinforcing terminal 30 as an example to describe the specific structures thereof. The first reinforcing terminal 30 includes a first upright portion 301, and a first pressing portion 302 formed by being bent from a front edge of the first upright portion 301 and extending forward. In this embodiment, the first pressing portion 302 is L-shaped. Moreover, the first reinforcing terminal 30 further includes a first notch 303 formed on a rear edge of the first upright portion 301.

Please refer to FIGS. 2 and 4, when the first reinforcing terminal 30 and the first conductive terminal 20 are combined together, the first upright portion 301 of the first reinforcing terminal 30 is attached to an outer side of the corresponding first vertical plate 201 of the first conductive terminal 20, and a first end portion 304 of the first pressing portion 302 presses an outer side of the corresponding first flexible arm 202 of the first conductive terminal 20. Specifically, the first end portion 304 of the first pressing portion 302 of the first reinforcing terminal 30 and the other first reinforcing terminal 30' can together clamp the first arc protruding parts 205 of the first conductive terminal 20, thereby providing a reinforcing function for the first conductive terminal 20. Moreover, the first bending plate 208 of the first conductive terminal 20 enters into the first notch 303 (the numeral seen in FIG. 6) of the corresponding first reinforcing terminal 30, and the first holding plate 207 of the first conductive terminal 20 crosses a top edge of the first upright portion 301 of the corresponding first reinforcing terminal 30 to be ready for being mated with the first holding groove 113' of the base 10.

The following text will describe the second terminal assembly, the main structures of which are similar to those of the first terminal assembly.

Please refer to FIGS. 6 and 8, the second terminal assembly includes a second conductive terminal 40 and two second reinforcing terminals 50, 50' located on two sides of the second conductive terminal 40.

As shown in FIGS. 6 and 7, the second conductive terminal 40 includes two parallel arranged second vertical plates 401, two pairs of second flexible arms 402 formed by being separately bent from front edges of the two second vertical plates 401 and extending forward, a second horizontal plate 403 connecting upper edges of the two second vertical plates 401, and a second mounting end 404 located under one of the two second vertical plates 401. Each second flexible arm 402 forms a second arc protruding part 405 and a second head part 406 (406'). The second arc protruding parts 405 of the two pairs of the second flexible arms 402 are close to each other, but are spaced a distance. The two second head parts 406, 406' thereof extend away from each other to form a splayed shape. The outward extension length of the second head part 406' is larger than that of the second head part 406. Further, the second conductive terminal 40 includes an upright second holding plate 407 and an L-shaped second holding plate 407', which are separately formed on the upper edges of the two second vertical plates 401. The second conductive terminal 40 also includes two second bending plates 408, which are separately formed on rear edges of the two second vertical plates 401. In this embodiment, the second mounting end 404 of the second conductive terminal 40 is vertical and integral with one of the two second vertical plates 401. Of course, the second mounting end 404 may be disposed to be L-shaped according to need in others embodiments.

Referring to FIGS. 6 and 7, the main structures of the two second reinforcing terminals 50, 50' are the same, and only the detail structures are slightly different. Here will take one second reinforcing terminal 50 as an example to describe the specific structures. The second reinforcing terminal 50 includes a second upright portion 501, and a second pressing portion 502 formed by being bent from a front edge of the second upright portion 501 and extending forward. In this embodiment, the second pressing portion 502 is L-shaped. Moreover, the second reinforcing terminal 40 further includes a second notch 503 formed on a rear edge of the second upright portion 501.

Referring to FIG. 6, the difference between the second reinforcing terminal 50 and the other second reinforcing terminal 50' is that: the shapes or sizes of the second upright portions 501, 501' are different. Further, the second reinforcing terminal 50 also includes a recess 504 formed on a top edge thereof. The L-shaped second holding plate 407' of the second conductive terminal 40 can cross the recess 504.

Please refer to FIGS. 2 and 4, when the second reinforcing terminal 50 and the second conductive terminal 40 are combined together, the second upright portion 501 of the second reinforcing terminal 50 is attached to an outer side of the corresponding second vertical plate 401 of the second conductive terminal 40, and a second end portion 505 of the second pressing portion 502 presses an outer side of the corresponding second flexible arm 402 of the second conductive terminal 40. Specifically, the second end portion 504 of the second pressing portion 502 of the second reinforcing terminal 50 and the other second reinforcing terminal 50' can together clamp the second arc protruding parts 405 of the second conductive terminal 40, thereby providing a reinforcing function for the second conductive terminal 40. Moreover, the second bending plate 408 of the second conductive terminal 40 enters into the second notch 503 (the numeral seen in FIG. 6) of the corresponding second reinforcing terminal 50, and the L-shaped second holding plate 407' of the second conductive terminal 40 crosses the recess 504 of the second upright portion 501 of the corresponding second reinforcing terminal 50 to be ready for being mated with the second holding groove 116' of the base 10.

The following text will describe the mounting relationship of the first and second terminal assemblies and the base 10.

Referring to FIGS. 1 and 3, the first terminal assembly is mounted in the first terminal-receiving passage 105 of the base 10. The two first flexible arms 202 of the first conductive terminal 20 are inserted from the two sides of the first partition 109 into the two sides of the first insertion opening 103. The first arc protruding parts 205 separately protrude from the corresponding first windows 107 into the first insertion opening 103 to be ready for being electrically engaged with an upper part 90 of a butt connector 9 (shown in FIG. 1 by dotted lines). The first horizontal plate 203 of the first conductive terminal 20 is inserted into the first space 111 above the first partition 109, and can be prevented from being overly forward inserted into the base by the first shoulder 112 (shown in FIG. 5). The first holding plates 207 of the first conductive terminal 20 are held in the corresponding first holding grooves 113, 113' of the base 10. The first mounting end 204 passes through the first locking groove 117 of the base 10 and extends out of the bottom surface of the base 10.

Please refer to FIGS. 1 and 3, it is the general same as the above assembly. The second terminal assembly is mounted in the second terminal-receiving passage 106 of the base 10. The two second flexible arms 402 of the second conductive terminal 40 are inserted from the two sides of the second partition 110 into the two sides of the second insertion opening 104. The second arc protruding parts 405 separately protrude from the corresponding second windows 108 (the numeral seen in FIG. 5) into the second insertion opening 104 to be ready for being electrically engaged with a lower part 91 of the butt connector 9. The second horizontal plate 403 of the second conductive terminal 40 is inserted into the second space 114 above the second partition 110, and can be prevented from being overly forward inserted into the base 10 by the second shoulder 114 (shown in FIG. 5). The L-shaped second holding plate 407' and the upright second holding plate 407 of the second conductive terminal 40 are mounted into the corresponding second holding grooves 116, 116' of the base 10. One second vertical plate 401 with the second mounting end 404 is retained by one second locking groove 118' (shown in FIG. 5), and the second mounting end 404 passes through the one second locking groove 118' of the base 10 to extend out of the bottom surface of the base 10. And the other second vertical plate 401 without the second mounting end 404 is retained in the other second locking groove 118 together with the second upright portion 501' of the second reinforcing terminal 50'.

As described above, the electrical power connector 1 of the present invention employs the first and second conductive terminals 20, 40 having good elastic. The first and second reinforcing terminals 30, 50 are separately attached on the first and second conductive terminals 20, 40 to make the electrical power connector 1 produce a larger electrical contact force between the first and second conductive terminals 20, 40 and the butt connector 9, and further provide a high conductivity. It can be seen that the first and second terminal assemblies of the present invention can provide a better electrical performance and a long term reliable connection. Further, because the electrical power connector 1 employs two separate terminal assemblies, which can use two kinds of different polarity currents, to expand the use range of the electrical power connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical power connector, comprising:

a base including an engaging portion located at the front thereof, a mounting portion located at the rear thereof, a first insertion opening formed on the engaging portion, a second insertion opening formed on the engaging portion and located under the first insertion opening, a first terminal-receiving passage located on left and right sides of the first insertion opening, communicated with the first insertion opening and extending to a rear surface of the mounting portion, and a second terminal-receiving passage located on left and right sides of the second insertion opening, communicated with the second insertion opening and extending to the rear surface of the mounting portion;

a first terminal assembly being mounted in the first terminal-receiving passage and including a first conductive terminal and two first reinforcing terminals located on two sides of the first conductive terminal; the first conductive terminal having two first vertical plates, two pairs of first flexible arms formed by being separately bent from front edges of the two first vertical plates and extending forward, a first horizontal plate connecting the two first vertical plates, and a first mounting end located under one of the two first vertical plates; each first reinforcing terminal having a first upright portion attached to an outer side of the corresponding first vertical plate, and a first pressing portion that is formed by being bent from a front edge of the first upright portion and extending forward and presses an outer side of the corresponding first flexible arm; wherein the two first vertical plates are mounted in the mounting portion, the first flexible arms passing through the first terminal-receiving passage to protrude into the first insertion opening, the first horizontal plate being fixed in the mounting portion, and the first mounting end extending out of a bottom surface of the base; and a second terminal assembly being mounted in the second terminal-receiving passage and including a second conductive terminal and two second reinforcing terminals located on two sides of the second conductive terminal; the second conductive terminal having two second vertical plates, two pairs of second flexible arms formed by being separately bent from front edges of the two second vertical plates and extending forward, a second horizontal plate connecting the two second vertical plates, and a second mounting end located under one of the two second vertical plates; each second reinforcing terminal having a second upright portion attached to an outer side of the corresponding second vertical plate, and a second pressing portion that is formed by being bent from a front edge of the second upright portion and extending forward and presses an outer side of the corresponding second flexible arm; wherein the two second vertical plates are mounted in the mounting portion, the second flexible arms passing through the second terminal-receiving passage to protrude into the second insertion opening, the second horizontal plate being fixed in the mounting portion, and the second mounting end extending out of the bottom surface of the base.

2. The electrical power connector as claimed in claim 1, wherein the first and second insertion openings are arranged up and down in a left-right staggered arrangement, and communicated with each other.

3. The electrical power connector as claimed in claim 2, wherein the mounting portion of the base includes an upright first partition and an upright second partition, which are disposed in a left-right staggered arrangement; the first partition is located in the first terminal-receiving passage and divides the first terminal-receiving passage into two parts; the first partition extends forward from the rear surface of the mounting portion and is stopped on the first insertion opening; the second partition is located in the second terminal-receiving passage and divides the second terminal-receiving passage into two parts; and the second partition extends forward from the rear surface of the mounting portion and is stopped on the second insertion opening.

4. The electrical power connector as claimed in claim 3, wherein the base disposes a first space formed between the first partition and an inner top wall of the first terminal-receiving passage, and a first shoulder formed on the top of the first partition; the base further disposes two first holding grooves, which are separately formed on left and right inner sidewalls of the first terminal-receiving passage and located on two sides of the first partition; the base forms at least one first window located on each of the left and right sides of the first insertion opening and used to communicate the first insertion opening with the first terminal-receiving passage; the base further forms a first locking groove on the mounting portion; and the first locking groove is formed on an inner bottom wall of the first terminal-receiving passage and vertically extends downward to pass through the bottom surface of the mounting portion.

5. The electrical power connector as claimed in claim 4, wherein each first flexible arm forms a first arc protruding part and a first head part; the first arc protruding parts of the two pairs of the first flexible arms are close to each other and are spaced apart, and the first head parts thereof extend away from each other to form a splayed shape; an outward extension length of one first head part is larger than that of the other first head part; the first conductive terminal includes two first holding plates, which are separately formed on the upper edges of the two first vertical plates; each of the two first holding plates are bent toward outside of the first conductive terminal to form an L shape; the first conductive terminal further includes two first bending plates, which are separately formed on rear edges of the two first vertical plates;

wherein the first arc protruding parts protrude from the corresponding first windows into the first insertion opening; the first horizontal plate is inserted into the first space above the first partition; the first holding plates are held in the corresponding first holding grooves; and the first mounting end passes through the first locking groove and extends out of the bottom surface of the base.

6. The electrical power connector as claimed in claim 5, wherein the first pressing portion is L-shaped; two first end portions separately formed on the first pressing portions of the two first reinforcing terminals together clamp the first arc protruding parts of the first conductive terminal; each first reinforcing terminal further has a first notch formed on a rear edge of the first upright portion; the first bending plate of the first conductive terminal enters into the first notch of the corresponding first reinforcing terminal; and the first holding plate of the first conductive terminal crosses a top edge of the first upright portion of the corresponding first reinforcing terminal to be engaged with the first holding groove of the base.

7. The electrical power connector as claimed in claim 3, wherein the base disposes a second space formed between the second partition and an inner top wall of the second terminal-receiving passage, and a second shoulder formed on the top of the second partition; the base further disposes two second holding grooves, which are separately formed on left and right inner sidewalls of the second terminal-receiving passage and located on two sides of the second partition; the base forms at least one second window located on each of the left and right sides of the second insertion opening and used to communicate the second insertion opening with the second terminal-receiving passage; the base further forms two second locking grooves on the mounting portion; and the two second locking grooves are separately located on the two sides of the second partition, are formed on an inner bottom wall of the second terminal-receiving passage and passes through the bottom surface of the mounting portion.

8. The electrical power connector as claimed in claim 7, wherein each second flexible arm forms a second arc protruding part and a second head part; the second arc protruding parts of the two pairs of the second flexible arms are close to each other and are spaced apart, and the second head parts thereof extend away from each other to form a splayed shape; an outward extension length of one second head part is larger than that of the other second head part; the second conductive terminal includes an upright second holding plate and an L-shaped second holding plate, which are separately formed on the upper edges of the two second vertical plates; the second conductive terminal further includes two second bending plates, which are separately formed on rear edges of the second vertical plates;

wherein the second arc protruding parts protrude from the corresponding second windows into the second insertion opening; the second horizontal plate is inserted into the second space above the second partition; the upright second holding plate and the L-shaped second holding plate are separately held in the corresponding second holding grooves; one second vertical plate with the second mounting end is retained by one second locking groove, and the second mounting end passes through the one second locking groove to extend out of the bottom surface of the base; and the other second vertical plate without the second mounting end is retained in the other second locking groove together with the second upright portion of the second reinforcing terminal.

9. The electrical power connector as claimed in claim 8, wherein the second pressing portion is L-shaped; two second end portions separately formed on the second pressing portions of the two second reinforcing terminals together clamp the second arc protruding parts of the second conductive terminal; each second reinforcing terminal further has a second notch formed on a rear edge of the second upright portion; the second bending plate of the second conductive terminal enters into the second notch of the corresponding second reinforcing terminal; the L-shaped second holding plate of the second conductive terminal crosses a top edge of the second upright portion of the corresponding second reinforcing terminal to be engaged with the second holding groove of the base.

10. A terminal assembly, which is applied to an electrical power connector, comprising:

a conductive terminal having two vertical plates, two pairs of flexible arms formed by being separately bent from front edges of the two vertical plates and extending forward, a horizontal plate connecting the two vertical plates, and a mounting end located under one of the two vertical plates; wherein each flexible arm forms an arc protruding part and a head part; the arc protruding parts of the two pairs of the flexible arms being close to each other and being spaced apart, and the head parts thereof extending away from each other to form a splayed shape; an outward extension length of one head part being larger than that of the other head part; and two reinforcing terminals, which is located on two sides of the conductive terminal, and each of which has an upright portion attached to an outer side of the corresponding vertical plate, and an L-shaped pressing portion that is formed by being bent from a front edge of the upright portion and extending forward and presses an outer side of the corresponding flexible arm; wherein two end portions of the L-shaped pressing portions of the two reinforcing terminals together clamp the arc protruding parts of the conductive terminal.

* * * * *